US007993146B2

(12) United States Patent
Midorikawa

(10) Patent No.: US 7,993,146 B2
(45) Date of Patent: Aug. 9, 2011

(54) ELECTRICAL CONNECTOR

(75) Inventor: Kazuya Midorikawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/624,510

(22) Filed: Nov. 24, 2009

(65) Prior Publication Data

US 2010/0136841 A1 Jun. 3, 2010

(30) Foreign Application Priority Data

Nov. 28, 2008 (JP) ..... 2008-304352

(51) Int. Cl.
*H01R 12/00* (2006.01)

(52) U.S. Cl. ..... 439/74

(58) Field of Classification Search ..... 439/74, 439/295, 284, 83, 66, 247, 65, 876, 95, 342, 439/70–71

See application file for complete search history.

(56) References Cited

U.S. PATENT DOCUMENTS

| | | | | |
|---|---|---|---|---|
| 7,465,171 | B2 * | 12/2008 | Miyazaki et al. | 439/74 |
| 7,758,352 | B2 * | 7/2010 | Zeng | 439/74 |
| 2006/0199403 | A1 * | 9/2006 | Tsai | 439/74 |

FOREIGN PATENT DOCUMENTS

| | | | |
|---|---|---|---|
| JP | 05-190227 | A | 7/1993 |
| JP | 2006-059656 | A | 3/2006 |
| JP | 2006-253159 | A | 9/2006 |

OTHER PUBLICATIONS

Japan Patent Office, Office Action for Application 2008-304352, Dec. 15, 2010.

* cited by examiner

*Primary Examiner* — Edwin A Leon
(74) *Attorney, Agent, or Firm* — Kubotera & Associates, LLC

(57) ABSTRACT

An electrical connector (a connector) includes a housing and a terminal disposed in the housing. The terminal includes a contact portion. When the connector is fitted to a mating connector in a fitting direction, the contact portion pushes a mating terminal of the mating connector in a pushing direction perpendicular to the fitting direction and deforms the mating terminal elastically in the pushing direction. The contact portion includes a guide portion and a sliding contact portion with a protruded band shape situated at a rear position in the fitting direction relative to the guide portion. The guide portion guides the mating terminal and the sliding contact portion slides against the mating terminal when the connector is fitted to the mating connector.

8 Claims, 5 Drawing Sheets

ELECTRICAL CONNECTOR

BACKGROUND OF THE INVENTION AND RELATED ART STATEMENT

The present invention relates to an electrical connector including a housing and a terminal disposing in the housing.

When a conventional electrical connector (a connector) is fitted to a mating connector, in some cases, there is a foreign object between a terminal and a mating terminal of the mating connector or there is a film formed on a surface of the terminal or the mating terminal. For example, the foreign object may include a dust and so on, and the film may include an oxide film and so on. The foreign object described above can cause a poor electrical contact between the terminal and the mating terminal.

Patent Reference has disclosed a conventional electrical connector. According to Patent Reference, when the conventional electrical connector is fitted to a mating connector, a terminal thereof and a mating terminal of the mating connector slide against each other, thereby removing a foreign object and so on situated between the terminal and the mating terminal.

Patent Reference: Japanese Patent Publication No. 2006-059656

In the conventional electrical connector, a plug contact as a terminal of a plug connector is formed of a metal plate with a band shape curved in an approximate crank shape in a thickness direction thereof. The plug contact includes a contact portion for contacting with a receptacle contact as a terminal of a receptacle connector. The contact portion is situated at a middle portion of the plug contact and extends in a fitting direction (a vertical direction).

Further, the contact portion includes a protrusion gently protruding toward the receptacle contact in a horizontal direction and two protruding portions formed continuously next to the protrusion. The protruding portion has a protruded band shape protruding toward the receptacle contact. The protruding portion extends toward a lower side in the vertical direction and has a width narrower than that of the protrusion. The protrusion and the protruding portions protrude by the same amount, and protruding surfaces of the protrusion and the protruding portions are situated on the same plane.

The receptacle contact is formed of a metal plate with a band shape curved in a lateral S-shape in a thickness direction of the metal plate. The receptacle contact includes a bent portion extending in the vertical direction. The bent portion includes a contact protruding portion protruding toward the plug contact and extends in a direction perpendicular to the vertical direction.

When the plug connector is fitted to the receptacle connector, the protrusion of the plug contact guides the contact protruding portion with a gently curved surface thereof and slides against the contact protruding portion, immediately followed by the protruding portions. Accordingly, when the conventional electrical connector is fitted to the mating connector, the foreign object between the terminal and the mating terminal is removed in a relatively wider area by a sliding contact with a relative elastic deformation between the contact protruding portion and the protrusion having a relatively wider width. Then, the foreign object can be removed further with stronger force by a subsequent sliding contact between the contact protruding portion and the protruding portions having a relatively narrower width.

In the conventional electrical connector disclosed in Patent Reference, when the plug connector is fitted to the receptacle connector, the protruding portions slide against the contact protruding portion of the receptacle contact following to the protrusion of the plug contact. As described above, the protruding portions are formed continuously next to the protrusion. Further, the protrusion and the protruding portions protrude by the same amount, and the protruding surfaces of the protrusion and the protruding portions are situated on the same plane. As a result, when the contact protruding portion of the receptacle connector is guided to the protrusion of the plug connector and then slides against the protruding portions, the contact protruding portion smoothly moves over from the protrusion to the protruding portions. Consequently, the foreign object cannot removed effectively since the contact protruding portion does not deform elastically further in a short period of time upon moving over from the protrusion to the protruding portions.

In view of the problems described above, an object of the present invention is to provide an electrical connector capable of removing the foreign object effectively by a sliding contact between terminals of the electrical connector and a mating connector when the electrical connector is fitted to the mating connector.

Further objects and advantages of the invention will be apparent from the following description of the invention.

SUMMARY OF THE INVENTION

In order to attain the objects described above, according to the present invention, an electrical connector to be fitted to a mating connector includes a housing and a terminal disposed in the housing.

In the present invention, the terminal includes a contact portion. When the connector is fitted to the mating connector in a fitting direction, the contact portion pushes a mating terminal of the mating connector in a pushing direction perpendicular to the fitting direction and deforms the mating terminal elastically in the pushing direction. The contact portion includes a guide portion and a sliding contact portion situated at a rear position in the fitting direction relative to the guide portion. The guide portion guides the mating terminal and the sliding contact portion slides against the mating terminal when the connector is fitted to the mating connector. In addition, the sliding contact portion is formed in a protruded band shape extending in the fitting direction and protrudes further than the guide portion.

In the present invention, the sliding contact portion protrudes further than the guide portion in the pushing direction. Accordingly, when the connector is fitted to the mating connector, after being guided by the guide portion, the mating terminal deforms elastically further by a large amount as abutting against a front edge of the sliding contact portion in the fitting direction. Then, the mating terminal has a sliding contact with a top portion of the sliding contact portion. In other words, prior to the sliding contact with the top portion of the sliding contact portion, the mating terminal abuts against the front edge of the sliding contact portion with a large amount of contact pressure. As a result, a foreign object and so on can be removed effectively, by abutting against the front edge.

It is preferable that each of the front edges of a plurality of the sliding contact portions is situated at a different position in the fitting direction. With the front edges situated at the different positions in the fitting direction, the mating terminal contacts with each of the front edges of the sliding contact portions in different timings. Accordingly, it is possible to reduce total resistance force generated by an impact when the connector is fitted to the mating connector. As a result, the connector can be fitted to the mating connector more easily.

It is preferable that the front edge of the sliding contact portion in the fitting direction is formed in a tapered shape with an inclined surface approaching toward the guide portion of the contact portion in the fitting direction. With the top portion formed in the tapered shape, the mating terminal begins to contact with the top portion of the sliding contact portion after being guided by the tapered surface of the front edge of the sliding contact portion. Consequently, it is possible to further reduce the resistance force generated as the connector is fitted to the mating connector. As a result, the connector can be fitted to the mating connector easily further.

It is preferable that the sliding contact portion has a triangular sectional shape or a curved sectional shape along a plane perpendicular to the fitting direction.

As described above, in the present invention, since the sliding contact portion for contacting with the mating terminal protrudes further than the guide portion, the mating terminal can contact with the front edge of the sliding contact portion with a large amount of the contact pressure before the sliding contact with the top portion of the sliding contact portion when the connector is fitted to the mating connector. As a result, it is possible to effectively remove the foreign object and so on situated between the terminal and the mating terminal. As a result, it is possible to prevent a poor electrical contact between the connector and the mating connector certainly.

BRIEF DESCRIPTION OF THE DRAWINGS

FIGS. 3(A) and 3(B) are sectional views showing the connector and a mating connector according to the embodiment of the present invention, wherein FIG. 3(A) is a sectional view showing the connector and the mating connector in a state before the connector is fitted to the mating connector and FIG. 3(B) is a sectional view showing the connector and the mating connector in a state after the connector is fitted to the mating connector;

and

Figure 4:
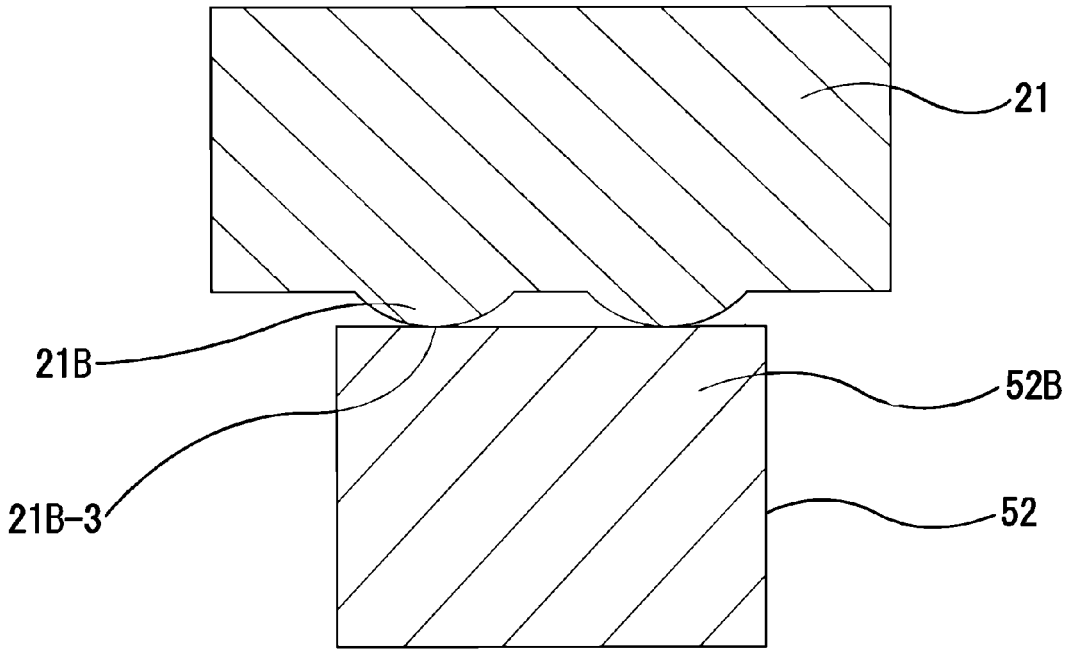

FIG. 4 is a sectional view showing the connector and the mating connector taken along a plane perpendicular to a direction that the connector is fitted to the mating connector at a position of a sliding contact portion of the terminal of the connector in a state the terminal of the connector slides against a terminal of the mating connector.

DETAILED DESCRIPTION OF THE PREFERRED EMBODIMENTS

Hereunder, an embodiment of the present invention will be explained with reference to the accompanying drawings.

Figure 1:
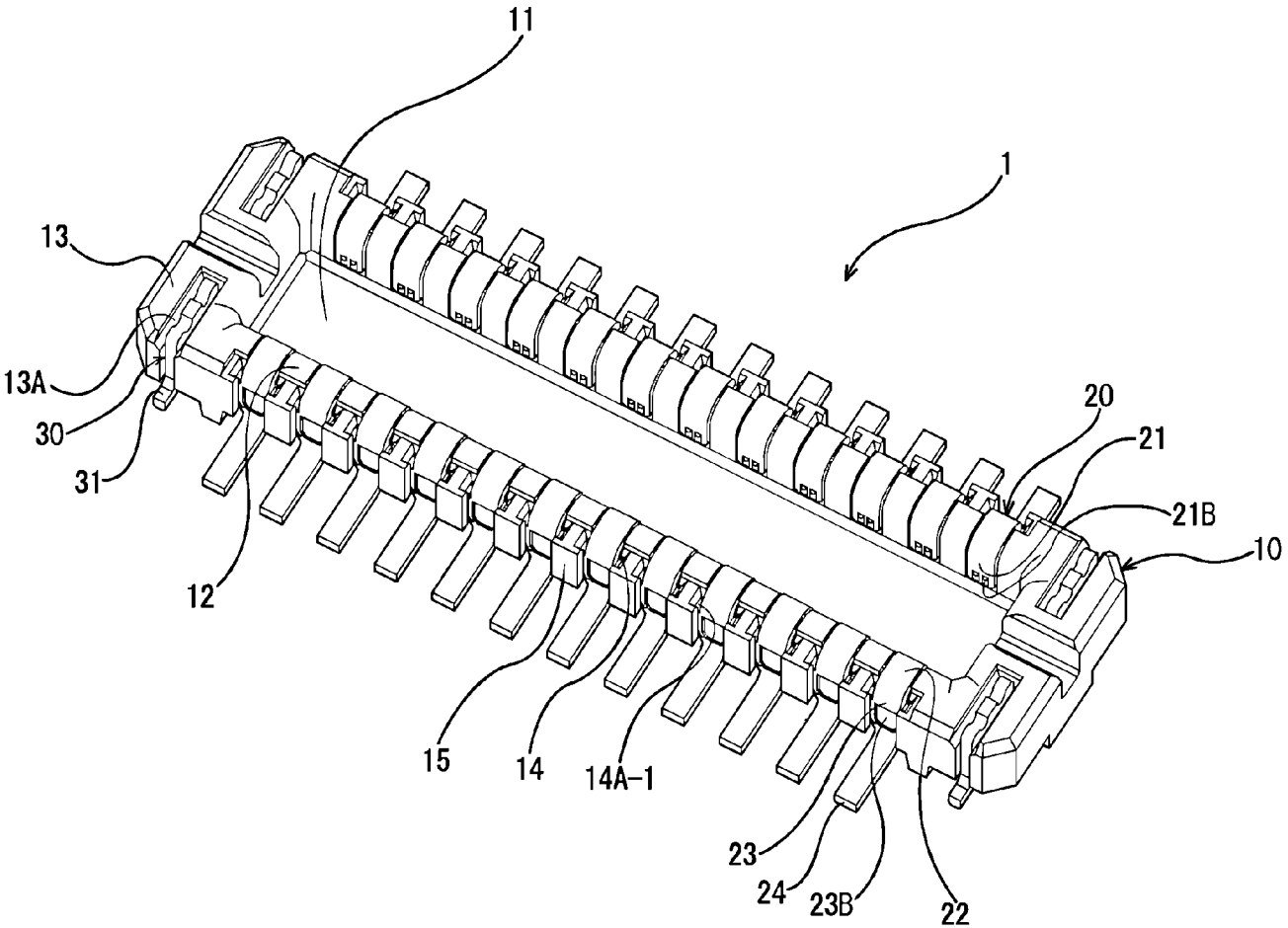
FIG. 1 is a perspective view showing an electrical connector (a connector) according to an embodiment of the present invention.

FIG. 1 is a perspective view showing an electrical connector 1 (a connector 1) for a circuit board, according to an embodiment of the present invention. The connector 1 includes a housing 10 having an approximate rectangular shape and made from a synthetic resin; a plurality of terminals 20 disposed in the housing 10 in a longitudinal direction of the housing 10; and a plurality of metal fixtures 30 being held with the housing 10. The metal fixture 30 is situated at an end portion of the connector 1 in the longitudinal direction of the connector 1.

As shown in FIG. 1, the terminal 20 is disposed in a form of two rows. The terminals 20 disposed in one of the rows face the terminals 20 disposed in another row, in a direction perpendicular to both of a direction the terminals are disposed (a terminal disposing direction) and a height direction of the connector 1. A direction the rows of the terminals 20 face each other will be referred as "a terminal facing direction".

The housing 10 includes a central recess portion 11 at a central portion thereof, extending in the terminal disposing direction. The central recess portion 11 opens toward an upper direction in FIG. 1. As shown in FIG. 1, the central recess portion 11 is surrounded by two side wall portions 12 extending in the terminal disposing direction and two end wall portions 13 extending in the terminal facing direction. Two of the side wall portions 12 are connected at end portions thereof through the end wall portion 13. The central recess portion 11 functions as an opening for receiving a central wall portion 42 of a mating connector 2 (described later) when the connector 1 is fitted to the mating connector 2.

The side wall portion 12 includes a separating wall portion 15 and a connecting wall portion 14 for connecting the separating wall portions 15 next to each other. The separating wall portion 15 is formed in the terminal disposing direction with a uniform interval. The connecting wall portions 14, provided as many as the number of the terminals 20, are disposed in the terminal disposing direction with a uniform interval.

The connecting wall portion 14 includes a recessed wall surface being recessed further than the separating wall portion 15 by a depth for holding the terminal 20. As shown FIG. 3(A), the terminal receiving portion 14A for receiving the terminal 20 is formed with the recessed wall surface of the side wall portion 14. The terminal receiving portion 14A has an approximately-same width with a width of the terminal 20 so as to receive the terminal 20.

As described later, a push-in portion 23 of the terminal 20 is pressed into a portion of the terminal receiving portion 14A situated at a side closer to an outside the connector 1. When the push-in portion 23 is pressed into the terminal receiving portion 14A, a protruding held portion 23A (described later) formed on both end edges of the push-in portion 23 is pressed by a terminal holding portion 14A-1. The terminal holding portion 14A-1 is formed with inner wall surfaces of the terminal receiving portion 14A facing each other in the terminal disposing direction.

The separating wall portion 15 includes a groove portion situated at outside the connector 1 in the terminal facing direction. The groove portion is provided with a wall surface perpendicular to the terminal disposing direction, being recessed in the terminal disposing direction and extending in the height direction of the connector 1. A bottom surface of the groove portion is the terminal holding portion 14A-1 for pressing the protruding held portion 23A of the push-in portion 23.

As shown in FIG. 1, the end wall portion 13 includes a holding groove portion 13A for holding the metal fixture 30 at both end portions in the terminal facing direction thereof. The holding groove portion 13A has a slit shape and extends in a direction perpendicular to the terminal disposing direction. The holding groove portion 13A further includes a holding portion (not shown) for holding the metal fixture 30, extending in the height direction of the connector 1.

Figure 2:
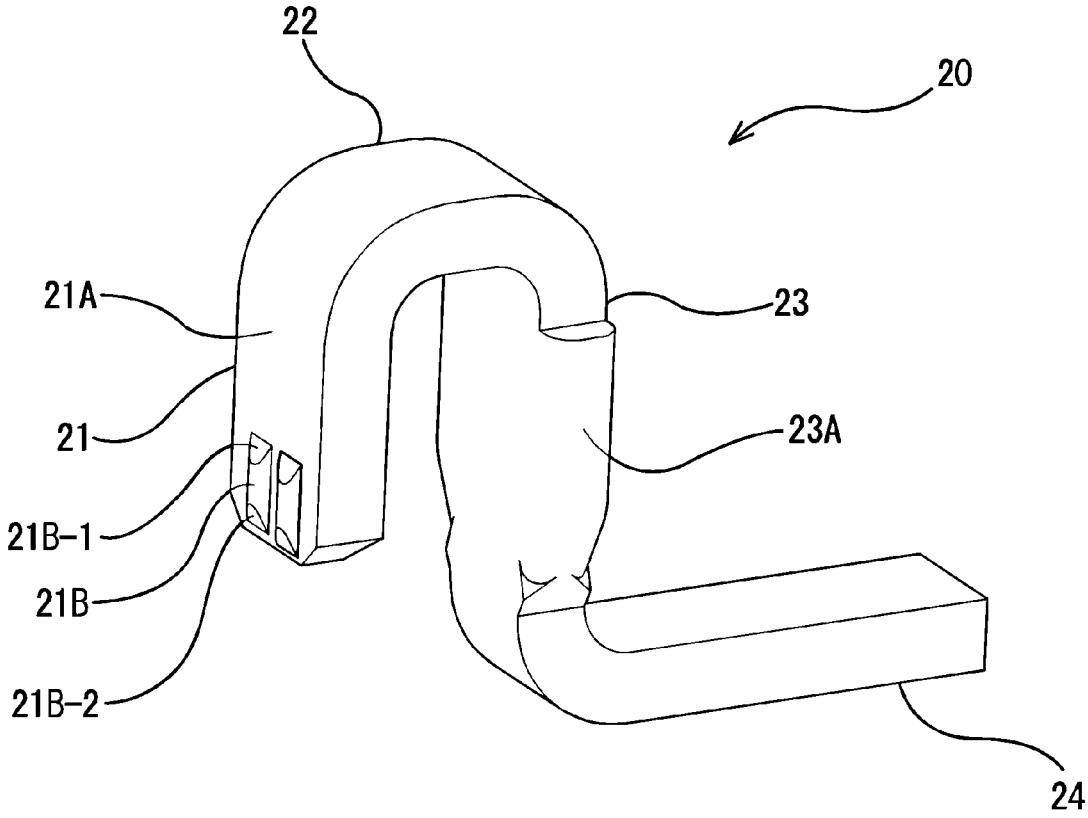
FIG. 2 is a perspective view showing a terminal of the connector according to the embodiment of the present invention.

FIG. 2 is a perspective view showing the terminal 20. The terminal 20 is made from a metal plate having a band shape. The terminal 20 is formed by bending the metal plate in a thickness direction thereof and applying a pressure. As shown in FIG. 2, the terminal 20 includes a contact portion 21 extending in a vertical direction in FIG. 2; a transition portion 22 extending from an upper end of the contact portion 21 in a direction perpendicular to the contact portion 21; a push-in portion 23 connected to the transition portion 22 and extending in a lower direction; and a connecting portion 24 extending from a lower end of the push-in portion 23.

The connecting portion 24 extends in a direction perpendicular to the push-in portion 23 and in a direction away from the contact portion 21. Accordingly, as shown in FIG. 2, the terminal 20 includes an upside-down U-shape portion formed with the contact portion 21 extending in the vertical direction, the push-in portion 23 facing the contact portion 21 and extending in parallel with the contact portion 21, and the transition portion 23 combining upper end portions of the contact portion 21 and the push-in portion 23. In addition, the terminal 20 includes an L-shape formed with the push-in portion 23 and the connecting portion 24 extending from the lower end of the push-in portion 23 toward a right direction in FIG. 2.

The connector 1 includes the housing 10 with the terminal 20 disposed therein. As described later, the connector 1 receives the mating connector 2 in a fitting direction from a side where the transition portion 22 of the terminal 20 is situated (shown in FIGS. 3(A) and 3(B)). Thus, an upper direction shown in FIGS. 1 and 2 are to be a front side of the fitting direction.

As described later, the contact portion 21 includes a guide portion 21A on an outer surface of the upside-down U-shape portion in the thickness direction of the metal plate or at a portion from an upper end side to a middle portion on an opposite surface of a surface facing the push-in portion 23 thereof. The contact portion 21 further includes a sliding contact portion 21B at a lower end portion of the outer surface thereof. The sliding contact portion 21B has a protruded band shape extending in the fitting direction and protrudes further than the guide portion 21A.

In the embodiment, two sliding contact portions 21B have a similar shape and extend in parallel to each other. Further, front edges 21B-1 and rear edges 21B-2 of the sliding contact portions 21B are situated at the same positions in the fitting direction, respectively. The sliding contact portions 21B are situated in an area narrower than a width of a mating contact portion 52 of a mating terminal 50 in a width direction of the contact portion 21 (shown in FIG. 4).

In addition, the sliding contact portion 21B has a curved sectional shape along a plane perpendicular to the fitting direction (shown in FIG. 4). As shown in FIG. 2, the front edge 21B-1 of the sliding contact portion 21B has a tapered shape with an inclined surface approaching toward the guide portion 21A upon extending to the front side of the fitting direction. The rear edge 21B-2 of the sliding contact portion 21B has a tapered shape with an inclined surface approaching toward the guide portion 21A upon extending to a rear side of the fitting direction.

As shown in FIG. 2, the push-in portion 23 includes a protruding held portion 23A at both ends in a width direction thereof. The protruding held portion 23A has a wider width than the contact portion 21 and extends in the fitting direction. Further, as shown in FIG. 1, the push-in portion 23 includes an engaged recess portion 23B on an outer surface of the upside-down U-shape portion thereof or on an opposite surface of a surface facing the contact portion 21 thereof.

The engaged recess portion 23B has a recess over an approximate whole of a surface. As described later, the engaged recess portion 23B engages an engaging portion 51C of the mating terminal 50 in the fitting direction when the connector 1 is fitted to the mating connector 2, thereby preventing the connector 1 from coming off from the mating connector 2 (shown in FIG. 3(B)).

Figure 3A:
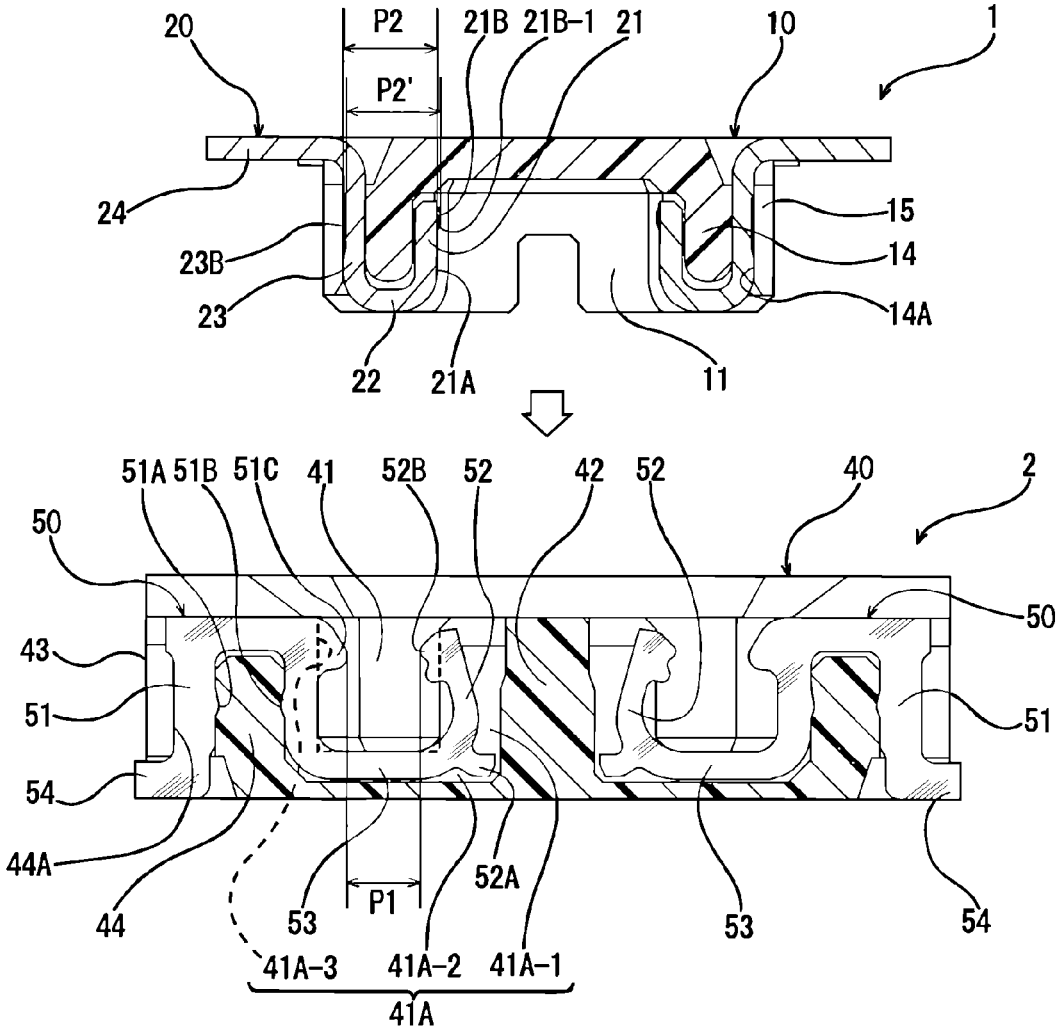

As shown in FIG. 1, in the connector 1 having the terminal 20 disposed in the housing 10, the contact portion 21 is exposed toward the central recess portion 11. In addition, the sliding contact portion 21B provided on the contact portion 21 protrudes further than the guide portion 21A toward the central recess portion 11, as shown in FIG. 3(A) as well. Further, the push-in portion 23 of the terminal 20 is pressed into and held with the portion situated at a side closer to the outside the connector 1 of the terminal receiving portion 14A. The connecting portion 24 extends toward outside the connector 1 in the terminal facing direction.

The metal fixture 30 shown in FIG. 1 is made by punching a metal plate. The metal fixture 30 includes a fixing portion (not shown) having an upside-down U-shape and a mounting portion 31 extending from a lower end of one of leg portions of the fixing portion in a direction perpendicular to the leg portion. As shown in FIG. 1, when the metal fixture 30 is attached to the housing 10, the mounting portion 31 extends outside the housing 10 in the terminal facing direction. A process of attaching the metal fixture 30 to the housing 10 will be described later. The metal fixture 30 is not necessarily required.

Next, a process of assembling the connector 1 will be explained. First, the terminal 20 is positioned so that the upside-down U-shape portion thereof formed with the contact portion 21, the transition portion 22, and the push-in portion 23 opens toward the lower direction. At the same time, the terminal 20 is positioned so that an edge portion of the connecting portion 24 thereof extends outside the connector 1 in a direction perpendicular to the longitudinal direction of the housing 10.

Then, the terminal 20 thus positioned is inserted into the terminal receiving portion 14A of the housing 10 from the upper direction in FIG. 1. Upon inserting the terminal 20, the push-in portion 23 of the terminal 20 is inserted into the portion situated in the closer side to the outside the connector 1 of the terminal receiving portion 14A. As a result, the protruding held portion 23A formed on both end edges of the push-in portion 23 cuts into the terminal holding portion 14A-1 formed with the inner wall surfaces of the terminal receiving portion 14A. Thereby, the terminal 20 is held in the terminal receiving portion 14A.

Further, as the push-in portion 23 is inserted, the upside-down U-shape portion formed with the contact portion 21, the transition portion 22, and the push-in portion 23 receive the connecting wall portion 14 from the lower direction or a direction the upside-down U-shape portion opens. When the terminal 20 is held with the terminal receiving portion 14A, as shown in FIG. 3(A), the terminal 20 has a space between the contact portion 21 thereof and the connecting wall portion 14 of the housing 10.

Next, the metal fixture 30 is positioned so that the upside-down U-shape thereof faces the lower direction. At the same time, the mounting portion 31 of the metal fixture 30 extends outside the connector 1 in the terminal facing direction. Then, the metal fixture 30 thus positioned is inserted into the holding groove portion 13A of the housing 10 from the upper direction in FIG. 1. Upon inserting the metal fixture 30, the metal fixture 30 receives the holding portion (not shown) at the upside-down U-shape thereof from the lower direction or an opening direction the upside-down U-shape thereof. When the metal fixture 30 is completely inserted, the metal fixture 30 sandwiches the holding portion with the upside-down U-shape thereof, thereby the metal fixture 30 is held within the holding groove portion 13A.

As described above, the plurality of terminals 20 and the metal fixture 30 are attached to the housing 10 and thus the connector 1 is assembled. In the embodiment, the terminal 20 is attached in the housing 10 prior to the metal fixture 30. The metal fixture 30 may be attached in the housing 10 prior to the terminal 20, not limiting to an order described above.

Figure 3B:
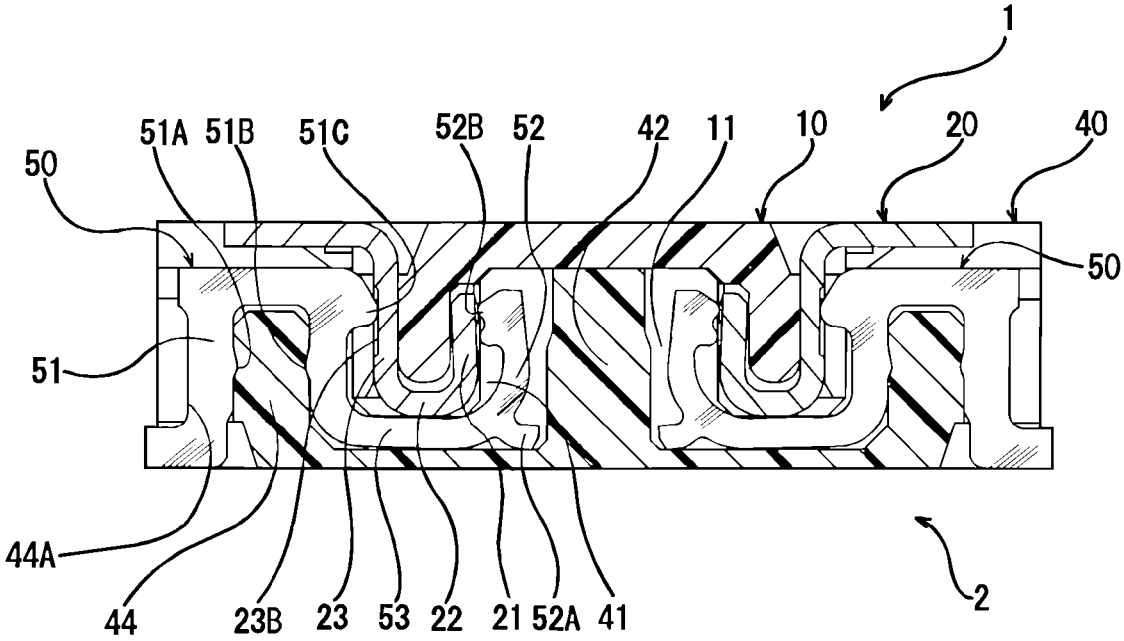

FIG. 3(A) is a sectional view showing the connector 1 and the mating connector 2 along the longitudinal direction thereof, in a state before the connector 1 is fitted to the mating connector 2. FIG. 3(B) is a sectional view showing the connector 1 and the mating connector 2 along the longitudinal direction thereof, in a state after the connector 1 is fitted to the mating connector 2. FIGS. 3(A) and 3(B) are sectional views along a plane situated where the terminal is located in the terminal disposing direction. In FIGS. 3(A) and 3(B), the connector 1 is shown as the connector 1 shown in FIG. 1 is turned upside down.

The mating connector 2 includes a housing 40 made from a synthetic resin, a plurality of terminals 50 (mating terminals 50) made from metal, and a plurality of metal fixtures (not shown). In FIG. 3(A), the plurality of the mating terminals 50 is disposed in a direction perpendicular to a sheet. The mating terminals 50 are disposed in a form of two rows. As shown in FIG. 3(A), the mating terminals 50 disposed in one of the rows face the mating terminals 50 disposed in another row in a horizontal direction in FIG. 3(A).

The housing 40 has an approximate rectangular shape extending in the terminal disposing direction or the direction perpendicular to the sheet in FIG. 3(A). As shown in FIG. 3(A), the housing has a symmetrical shape along an axis situated in the center of the two rows of the mating terminals 50. Accordingly, in the embodiment, a left portion of the housing 40 will be mainly explained.

The housing 40 includes two receptacle recess portions 41 extending in the terminal disposing direction. The receptacle recess portion 41 receives the upside-down U-shape portion of the terminal 20 of the connector 1 in FIG. 2, that is, a portion having a U-shape in FIG. 3(A), when the connector 1 is fitted to the mating connector 2.

The housing 40 further includes a central wall portion 42 extending in the terminal disposing direction thereof. The central wall portion 42 is situated at a central portion in the terminal facing direction of the receptacle recess portion 41. In other words, the central wall portion 42 is situated between two receptacle recess portions 41 corresponding to the terminals 20 in two rows.

As shown in FIG. 3(A) with solid lines and projected lines, the receptacle recess portion 41 includes a groove portion 41A in inner wall surfaces thereof. The groove portion 41A has an approximate similar width with a thickness of the mating terminal 50 and is carved in the horizontal direction and a vertical direction in FIG. 3(A).

As shown in FIG. 3(A), the groove portion 41A includes an inner groove portion 41A-1 extending in the fitting direction along the central wall portion 42; a lower groove portion 41A-2 extending in the terminal facing direction along a bottom portion of the housing; and an outer groove portion 41A-3 extending in the fitting direction along an inner wall surface of a terminal holding portion 44 (described later). The inner groove portion 41A-1, the lower groove portion 41A-2 and the outer groove portion 41A-3 are formed continuously, and have a U-shape as a whole.

The housing 40 includes the terminal holding portion 44 for holding the mating terminal 50 in a side wall portion 43 thereof. The side wall portion 43 forms an outer wall of the receptacle recess portion 41 extending in the terminal disposing direction. As shown in FIG. 3(A), the terminal holding portion 44 includes a recessed wall surface being recessed further than the side wall portion 43 by a depth for holding the mating terminal 50.

A space formed with the recessed wall surface functions as a holding groove portion 44A. The holding groove portion 44A formed as a recessed space has an approximately-same width with a width of the mating terminal 50 so as to receive the mating terminal 50. As described later, a held portion 51 having an upside-down U-shape portion of the mating terminal 50 is pressed into the terminal holding portion 44. Upon pressing in, as described later, the terminal holding portion 44 is sandwiched with two leg portions of the held portion 51.

The mating terminal 50 is formed by punching out a metal plate so as to maintain a flat plate surface of the metal plate. As shown in FIG. 3(A), the mating terminal 50 has an approximate lateral S-shape. In FIG. 3(A), the plate surface of the mating terminal 50 is parallel to a sheet surface. The mating terminals 50 facing each other have a similar shape. Thus, in the embodiment, only the mating terminal 50 situated at a left side in FIG. 3(A) is explained, and an explanation of the mating terminal 50 situated at a right side in FIG. 3(A) is omitted.

The mating terminal 50 situated at the left side in FIG. 3(A) includes the held portion 51, the mating contact portion 52, a combining portion 53 and a connecting portion 54. The held portion 51 having the upside-down U-shape portion is situated at a position closer to an outside the mating connector 2 in the terminal facing direction for sandwiching the terminal holding portion 44 of the housing 40. The mating contact portion 52 extends in the fitting direction forming a slight space 41A-1 with the central wall portion 42 in the terminal facing direction in the inner groove portion.

The combining portion 53 extends in the terminal facing direction combining a lower edge of the mating contact portion 52 and a lower edge of one of the leg portions of the held portion 51 being situated in the outer groove portion 41A-3. The connecting portion 54 extends from a lower edge of one of the leg portions of the held portion 51 being situated outside the groove portion 41A, to outside the mating connector 2 in the terminal facing direction.

The held portion 51 includes protrusions 51A and 51B protruding toward the terminal held portion 44 in each of the leg portions of the upside-down U-shape portion. The held portion 51 further includes the engaging portion 51C protruding toward the central wall portion 42 from an upper edge of one of the leg portions situated in the outer groove portion 41A-3. The mating contact portion 52 includes a stopper portion 52A at a lower edge thereof and a contact protrusion 52B at an upper portion thereof. The stopper portion 52A protrudes toward the central wall portion 42 and the contact protrusion 52B protrudes toward the terminal holding portion 44.

The stopper portion 52A prevents the mating terminal 50 of the mating connector 2 from being pulled in a direction the connector 1 is extracted when the connector 1 is extracted from the mating connector 2. For example, when the connector 1 is twisted upon the extraction thereof, the U-shape portion formed with one of the leg portions of the held portion 51, the mating contact portion 52 and the combining portion 53 may be pulled in the direction the connector 1 is extracted, accompanied with a rotation nearly around the engaging portion 51C. The stopper portion 52A abuts against the central wall portion 42 soon after the mating terminal 50 is pulled, thereby preventing the mating terminal 50 from being pulled any further.

As shown in FIG. 3(A), the mating contact portion 52 slightly inclines so that an upper edge thereof goes apart from the central wall portion 42. In the embodiment, as shown in FIG. 3(A), when the mating terminal 50 is in a free state, a distance P1 between the engaging portion 51C of the held portion 51 and the mating contact portion 52 is narrower than a distance P2 between the contact portion 21 and the push-in portion 23 of the terminal 20 of the connector 1. In addition, as shown in FIG. 3(A), the distance P1 is smaller than a distance P2' between a top portion of the sliding contact portion 21B and a bottom surface of the engaged recess portion 23B of the push-in portion 23 of the terminal 20.

In the embodiment, as described above, the mating connector 2 includes a plurality of the metal fixtures (not shown) for mounting on a circuit board (not shown). The metal fixture has a similar shape with the metal fixture 30 of the connector 1. Accordingly, an explanation about the metal fixture is omitted. The metal fixture is not necessarily required.

Next, a process of assembling the mating connector 2 will be explained. First, the mating terminal 50 is attached to the terminal holding portion 44 of the housing 40 from an upper side of the housing 40 in FIG. 3(A), maintaining a position that the upside-down U-shape portion of the held portion 51 thereof opens toward the lower direction and an edge portion of the connecting portion 54 thereof extends toward outside the mating connector 2 in a direction perpendicular to the longitudinal direction of the housing 40.

More specifically, the terminal holding portion 44 is inserted into between the leg portions of the held portion 51. Accordingly, the protrusions 51A and 51B of the mating terminal 50 cut into an outer surface of the terminal holding portion 44. As a result, the mating terminal 50 is held with the terminal holding portion 44, thereby preventing the mating terminal 50 from coming off. In addition, a U-shape portion formed with one of the leg portions of the upside-down U-shape portion of the held portion 51, the mating contact portion 52 and the combining portion 53 is put into the groove portion 41A, and the engaging portion 51C and the contact protrusion 52B protrude from the groove portion 41A.

Next, the metal fixture (not shown) is attached to the housing 40. A process of attaching the metal fixture is similar to the process of attaching the metal fixture 30 to the housing 10 of the connector 1. Accordingly, an explanation about the process of attaching the metal fixture is omitted.

As described above, the plurality of the mating terminals 50 is attached to the housing 40. Thereby, the mating connector 2 shown in FIG. 3(A) is assembled. In the embodiment, the mating terminal 50 is attached in the housing 40 prior to the metal fixture. The metal fixture may be attached to the housing 40 prior to the mating terminal 50, not limiting to an order described above.

Hereunder, a process of fitting of the connector 1 and the mating connector 2 (connectors) will be explained with reference to FIGS. 3(A), 3(B) and 4. Prior to fitting the connector 1 to the mating connector 2, the connector 1 is mounted to a circuit board (not shown) and the mating connector 2 is mounted another circuit board (not shown), respectively.

More specifically, the connecting portion 24 of the terminal 20 of the connector 1 is soldered to a corresponding circuit portion of the circuit board as well as soldering the mounting portion 31 of the metal fixture 30 to a corresponding portion of the circuit board. In addition, the connecting portion 54 of the mating terminal 50 of the mating connector 2 is soldered to a corresponding circuit portion of the another circuit board as well as soldering the mounting portion of the metal fixture to a corresponding portion of the another circuit board.

Next, as shown with an arrow in FIG. 3(A), the connector 1 is fitted to the mating connector 2, from the upper side of the mating connector 2 to the lower direction or toward the mating connector 2, maintaining a position that the central recess portion 11 thereof opens toward a lower direction. Upon starting the process of fitting the connectors, the guide portion 21A of the terminal 20 guides the contact protrusion 52B of the mating contact portion 52 of the mating terminal 50 with a curved portion situated at a lower edge thereof. At the same time, a curved portion of a lower edge of the push-in portion 23 of the terminal 20 abuts against the engaging portion 51C of the held portion 51 of the mating terminal 50.

As the connector 1 is pressed toward the lower direction further, the contact portion 21 of the terminal 20 pushes the contact protrusion 52B of the mating contact portion 52 of the mating terminal 50 in a direction toward the central wall portion 42 (a pushing direction). Thus the mating contact portion 52 deforms elastically in the pushing direction. As a result, the contact protrusion 52B widens a distance thereof for receiving the terminal 20, formed with the engaging portion 51C. Next, the terminal 20 is inserted into the mating terminal 50. That is, the U-shape portion formed with the contact portion 21, the transition portion 22 and the push-in portion 23 of the terminal 20 is inserted into the U-shape portion formed with the leg portion of the held portion 51, the mating contact portion 52 and the combining portion 53 of the mating terminal 50.

Further, the connector 1 is pushed in the lower direction, the guide portion 21A of the terminal 20 moves in the fitting direction, contacting with and sliding against the contact protrusion 52B of the mating connector 50 in the fitting direction. The engaging portion 51C of the mating terminal 50 slides against the push-in portion 23 of the terminal 20 in the fitting direction and then enters the engaged recess portion 23B of the push-in portion 23 with a top portion thereof.

As the connectors are fitted further, the contact protrusion 52B runs on the sliding contact portion 21B after being guided by the front edge 21B-1 of the sliding contact portion 21B of the contact portion 21, thereby increasing a contact pressure thereof rapidly. Then, as shown in FIG. 4, the contact protrusion 52B slides directly against a top portion 21B-3 of the sliding contact portion 21 in the fitting direction. As a result, when there is a foreign object between the terminal 20 and the mating terminal 50, the foreign object can be removed as the contact protrusion 52B slides against the top portion 21B-3 of the sliding contact portion 21B with the increased contact pressure, as described above. In addition, when an oxide film is formed on a surface of the contact protrusion 52B, the oxide film can be ground and thus removed as the contact protrusion 52B slides against the top portion 21B-3 with the increased contact pressure. Consequently, it is possible to prevent a poor electrical contact between the connectors certainly.

As shown in FIG. 3(B), as the connectors are fitted further, the central wall portion 42 of the mating connector 2 abuts against a bottom portion of the central recess portion 11 of the connector 1 with an upper surface thereof. Thereby, the connector 1 is fitted to the mating connector 2 completely. When the connector 1 is fitted to the mating connector 2 completely, the contact protrusion 52B of the mating terminal 50 contacts with the sliding contact portion 21B of the terminal 20 with the high contact pressure. Accordingly, the circuit board soldered to the connector 1 conducts electrically to another circuit board soldered to the mating connector 2. At this time, as shown in FIG. 3(B), the contact portion 21 receives reaction force from the mating contact portion 52 of the mating terminal 50, thus deforms elastically toward the connecting wall portion 14.

In addition, as shown in FIG. 3(B), when the connectors are fitted completely, the top portion of the engaging portion 51C is situated in the engaged recess portion 23B of the terminal 20. It is possible to prevent the connectors from coming off carelessly since the engaging portion 51C engages the engaged recess portion 23B.

A conventional electrical connector (a conventional connector) includes a terminal with a sliding contact portion situated in the same plane with a front portion of a contact portion in the fitting direction and not protruding from the front portion. Further, a front edge of the sliding contact portion is formed integrally with the front portion.

In the conventional connector thus configured, when the sliding contact portion of the terminal begins to slide against a contact protrusion of a mating contact portion of a mating terminal, the contact protrusion moves from the front portion to the sliding contact portion smoothly. As a result, a contact pressure does not change significantly and the mating contact portion does not increase an amount of an elastic deformation thereof rapidly. Consequently, the conventional connector can hardly remove the foreign object and so on.

In the connector 1 according to the present embodiment, the sliding contact portion 21B of the contact portion 21 of the terminal 21 protrudes further than the guide portion 21A of the contact portion 21 in the terminal facing direction. Accordingly, when the connector 1 is fitted to the mating connector 2, the contact protrusion 52B of the mating contact portion 52 of the mating terminal 50 increases an amount of an elastic deformation thereof in large upon abutting against the front edge 21B-1 of the sliding contact portion 21B after being guided by the guide portion 21A. In other words, the contact protrusion 52B contacts with the top portion 21B-3 of the sliding contact portion 21B after the contact pressure thereof is increased rapidly. That is, prior to a sliding contact against the top portion 21B-3 of the sliding contact portion 21B, the contact protrusion 52B abuts against the front edge 21B-1 of the sliding contact portion 21B with the increased contact pressure. As a result, it is possible to remove the foreign object and so on effectively for the contact protrusion 52B, by abutting against the front edge 21B-1.

In the embodiment, the front edge of the sliding contact portion of the terminal has the tapered shape with the inclined surface approaching toward the guide portion upon extending to the front side of the fitting direction. Accordingly, as described above, the contact protrusion of the mating terminal is guided by the front edge of the sliding contact portion and then begins to contact with the top portion of the sliding contact portion. Consequently, it is possible to reduce resistance force generated as the contact protrusion abuts against the sliding contact portion when the connectors are fitted. As a result, the connectors can be fitted easily.

In the embodiment, two sliding contact portions have the front edges situated at the same position in the fitting direction respectively. Each of the sliding contact portions may have the front edge situated at a different position in the fitting direction. When each of the front edges is situated at the different position in the fitting direction, the contact protrusion of the mating terminal abuts against each of the front edges of the sliding contact portions in a different timing. Accordingly, it is possible to further reduce the resistance force generated as the contact protrusion abuts against the sliding contact portion when the connectors are fitted, as compared to the embodiment described above, a case that the front edges of the sliding contact portions are situated at the same position in the fitting direction. As a result, the connectors can be fitted much easier.

In the embodiment, the sliding contact portion has the curved sectional shape along the plane perpendicular to the fitting direction. It is not limited to the curved sectional shape. The sliding contact portion may have a triangular sectional shape capable of contacting with the contact protrusion of the mating terminal with the top portion thereof or may have a sectional shape capable of contacting with the contact protrusion of the mating terminal with a plane thereof, such as a trapezoidal sectional shape.

In the embodiment, the sliding contact portion is situated at two positions. Accordingly, upon contacting with the sliding contact portion, the mating contact portion can obtain a more stable position in a width direction thereof, as compared to a case that the sliding contact portion is situated at only one position.

Moreover, the sliding contact portions may be situated at more than two positions. When the sliding contact portions are situated at more than two positions, the mating contact portion can obtain the stable position furthermore upon contacting with the sliding contact portion, since a number of the sliding contact portions is larger than the embodiment described above. Thereby, the foreign object and so on more can be removed effectively.

In the embodiment, the connector has the space between the contact portion and the connecting wall portion. The space between the contact portion and the connecting wall portion may not be formed, by sandwiching the connecting wall portion of the housing in the terminal facing direction with the contact portion and the push-in portion of the terminal.

In the embodiment, the sliding contact portion protrudes toward inside the connector in the terminal facing direction. When the terminal of the connector includes the contact portion exposing toward outside the connector and the mating terminal of the mating connector includes the mating contact portion with the contact protrusion protruding toward the central wall portion of the connector, the sliding contact portion formed on the contact portion may protrude toward outside the connector in the terminal facing direction.

The disclosure of Japanese Patent Application No. 2008-304352, filed on Nov. 28, 2008 is incorporated in the application by reference.

While the invention has been explained with reference to the specific embodiments of the invention, the explanation is illustrative and the invention is limited only by the appended claims.

What is claimed is:

1. An electrical connector to be connected to a mating connector having a mating terminal with a U-shape portion, comprising:

a housing including a receptacle portion for receiving the mating connector in a fitting direction; and a terminal disposed in the housing and to be accommodated in the U-shape portion of the mating terminal, said terminal including a contact portion for pushing the mating terminal of the mating connector in a pushing direction perpendicular to the fitting direction to elastically deform the mating terminal in the pushing direction, said contact portion including a guide portion for guiding the mating terminal and a sliding contact portion situated at a rear position in the fitting direction relative to the guide portion for sliding against the mating terminal, said sliding contact portion being arranged to protrude in the pushing direction further than the guide portion.

2. The electrical connector according to claim 1, wherein said sliding contact portion is formed in a protruded band shape extending in the fitting direction.

3. The electrical connector according to claim 2, wherein said sliding contact portion is situated at a plurality of positions.

4. The electrical connector according to claim 3, wherein each of said sliding contact portions includes a front edge situated at a different position in the fitting direction.

5. The electrical connector according to claim 1, wherein said sliding contact portion includes a front edge in the fitting direction, said front edge being formed in a tapered shape with an inclined surface approaching toward the guide portion in the fitting direction.

6. The electrical connector according to claim 1, wherein said sliding contact portion has a triangular sectional shape or a curved sectional shape along a plane perpendicular to the fitting direction.

7. The electrical connector according to claim 1, wherein said sliding contact portion is formed in a pair of protruded band shapes extending in parallel to each other in the fitting direction.

8. The electrical connector according to claim 1, wherein said terminal further includes a transition portion for abutting against a bottom of the U-shape portion so that the contact portion keeps pushing and elastically deforming the mating terminal in the pushing direction after the terminal is accommodated in the U-shape portion.

* * * * *